US005661927A

United States Patent [19]

Polowinczak et al.

[11] Patent Number: 5,661,927

[45] Date of Patent: Sep. 2, 1997

[54] SLIDING COUNTERBALANCE ASSEMBLY FOR A SASH WINDOW

[75] Inventors: Allen D. Polowinczak, Plainfield; James J. Prete, Hinsdale, both of Ill.; Michael P. Bratcher, Munster, Ind.; Mark V. Murphy, Chicago, Ill.

[73] Assignee: Ashland Products, Inc., Lowell, Ind.

[21] Appl. No.: 611,366

[22] Filed: Mar. 6, 1996

[51] Int. Cl.[6] ..... E05F 3/06

[52] U.S. Cl. ..... 49/447; 49/446

[58] Field of Search ..... 49/447, 444, 445, 49/446

[56] References Cited

U.S. PATENT DOCUMENTS

| | | | |
|---|---|---|---|
| 1,226,145 | 5/1917 | Taylor . | |
| 1,226,843 | 5/1917 | Arvine . | |
| 1,626,018 | 4/1927 | Wagniere | 49/445 |
| 1,760,226 | 5/1930 | Appleby | 49/445 |
| 1,836,080 | 12/1931 | Mantz . | |
| 1,925,059 | 8/1933 | Sheard et al. . | |
| 1,965,478 | 7/1934 | Smith . | |
| 2,067,164 | 1/1937 | Smith . | |
| 2,609,191 | 9/1952 | Foster . | |
| 2,609,192 | 9/1952 | Lermont . | |
| 2,609,193 | 9/1952 | Foster . | |
| 2,635,282 | 4/1953 | Trammell, Sr. et al. . | |
| 2,644,193 | 7/1953 | Anderberg . | |
| 2,684,499 | 7/1954 | Lewis . | |
| 2,732,594 | 1/1956 | Adams et al. . | |
| 2,739,344 | 3/1956 | Dickinson . | |
| 2,817,872 | 12/1957 | Foster . | |
| 2,873,472 | 2/1959 | Foster . | |
| 3,055,063 | 9/1962 | Peters . | |
| 3,118,190 | 1/1964 | Love . | |
| 3,150,420 | 9/1964 | Brenner . | |
| 3,348,335 | 10/1967 | Mauro . | |
| 3,445,964 | 5/1969 | Foster . | |
| 3,452,478 | 7/1969 | Foster . | |
| 3,452,480 | 7/1969 | Foster . | |
| 3,475,865 | 11/1969 | Arnes . | |
| 3,482,354 | 12/1969 | Trout . | |
| 3,789,549 | 2/1974 | Yip . | |
| 3,820,193 | 6/1974 | Foster . | |
| 3,844,066 | 10/1974 | Nobes . | |
| 3,869,754 | 3/1975 | Foster . | |
| 3,992,751 | 11/1976 | Foster et al. . | |
| 4,068,406 | 1/1978 | Wood . | |
| 4,089,085 | 5/1978 | Fitzgibbon . | |
| 4,227,345 | 10/1980 | Durham, Jr. . | |
| 4,363,190 | 12/1982 | Anderson . | |
| 4,452,012 | 6/1984 | Deal . | |
| 4,914,780 | 4/1990 | Rogers et al. | 49/446 |
| 4,935,987 | 6/1990 | Sterner, Jr. . | |
| 4,949,425 | 8/1990 | Dodson et al. | 49/466 |
| 4,949,506 | 8/1990 | Durham, Jr. . | |
| 4,953,258 | 9/1990 | Mennuto . | |
| 4,961,247 | 10/1990 | Leitzel et al. . | |
| 5,119,591 | 6/1992 | Sterner, Jr. et al. . | |
| 5,157,808 | 10/1992 | Sterner, Jr. . | |
| 5,210,976 | 5/1993 | Cripps . | |
| 5,232,208 | 8/1993 | Braid et al. . | |
| 5,353,548 | 10/1994 | Westfall . | |
| 5,365,638 | 11/1994 | Braid et al. . | |
| 5,463,793 | 11/1995 | Westfall . | |

OTHER PUBLICATIONS

Memorandum dated Apr. 4, 1991 by Maurice Edwin Sterner, Jr. Re: Improvement of Application of Constant Force Spring as Used for Balancers in Windows; and Drawing by Maurice Edwin Sterner, Jr., dated Apr. 4, 1991, Project No. 1127-I-0001.

*Primary Examiner*—Kenneth J. Dorner
*Assistant Examiner*—Curtis Cohen
*Attorney, Agent, or Firm*—Wallenstein & Wagner, Ltd.

[57] ABSTRACT

A slidable counterbalance assembly adapted for a sash window assembly disposed within a master frame is disclosed. A coiled leaf spring mounted on the counterbalance assembly has its upper end attached to the top of the guide rail channel of the master frame. A flexible strap is attached at one end to the sash window pivot brake and at the other end to the counterbalance assembly.

12 Claims, 2 Drawing Sheets

SLIDING COUNTERBALANCE ASSEMBLY FOR A SASH WINDOW

TECHNICAL FIELD

The present invention relates to a sliding counter-balance assembly for a sash window.

BACKGROUND PRIOR ART

A sash window disposed within a master frame is well known. The master frame is comprised of a pair of opposed vertical guide rails. The guide rails are adapted to slidably guide a pair of sash windows within the master frame. The guide rails are comprised of dual elongated channels, each channel having an elongated slot opening on the inside of the guide rail which extends the length of the channel.

The prior art, such as Westfall, U.S. Pat. No. 5,353,548, discloses a spring assembly to counterbalance the sash window within the master frame. Generally the spring assembly is a leaf spring which is wound into a spiral coil. The coiled spring is attached to the master frame at its upper end and the lower end of the spring is attached to a pivot brake assembly on the sash window. In this configuration, the distance that the sash window can move within the master frame is limited. The sash window cannot be moved upward beyond the position at which the spring is mounted. Additionally, the spring housing must fit entirely within the channel, thus limiting the width and the strength of the counterbalance spring.

SUMMARY OF THE INVENTION

It is an object of the invention to provide an improved counterbalance spring which allows for a greater range of movement for a pivotable sash window.

A pivotable sash window is disposed within a master frame. The master frame is comprised of a pair of opposed vertical guide rails which are adapted to slidably guide a pair of sash windows within the master frame. Each guide rail is comprised of dual elongated channels having an elongated slot opening on the inside of the guide rail.

A slidable counterbalance spring assembly is adapted to fit within the guide rail channel. The spring assembly has a backplate with an upper and a lower portion. An egress drum is mounted on the backplate and a coiled leaf spring is spirally wound around the egress drum. Alternatively, the coiled leaf spring may be directly mounted on a boss extending from the backplate. The spring has an upper end secured to the top of the guide rail channel. The spring upper end may be secured directly, or by a bracket. A spring cover is mounted in a position to retain the coiled spring. A boss is mounted upon the lower portion of the backplate and is adapted to receive a strap. The strap has upper and lower ends. The upper end is attached to the boss, and the lower end is attached to a pivot brake assembly which is mounted on a sash window.

When the sash window is moved to the top of the master frame, the strap moves upwardly in the channel allowing the counterbalance spring assembly to slide upward. As the counterbalance spring assembly slides upwardly the spring winds around the egress drum. This allows the sash window to move upward until the spring has been completely wound around the drum. Further upward movement, beyond this position, is possible by pushing the sash window upward causing the strap within the channel to flex.

Other features and advantages of the invention will be apparent from the following specification taken in conjunction with the following drawings.

DETAILED DESCRIPTION

Figure 1:
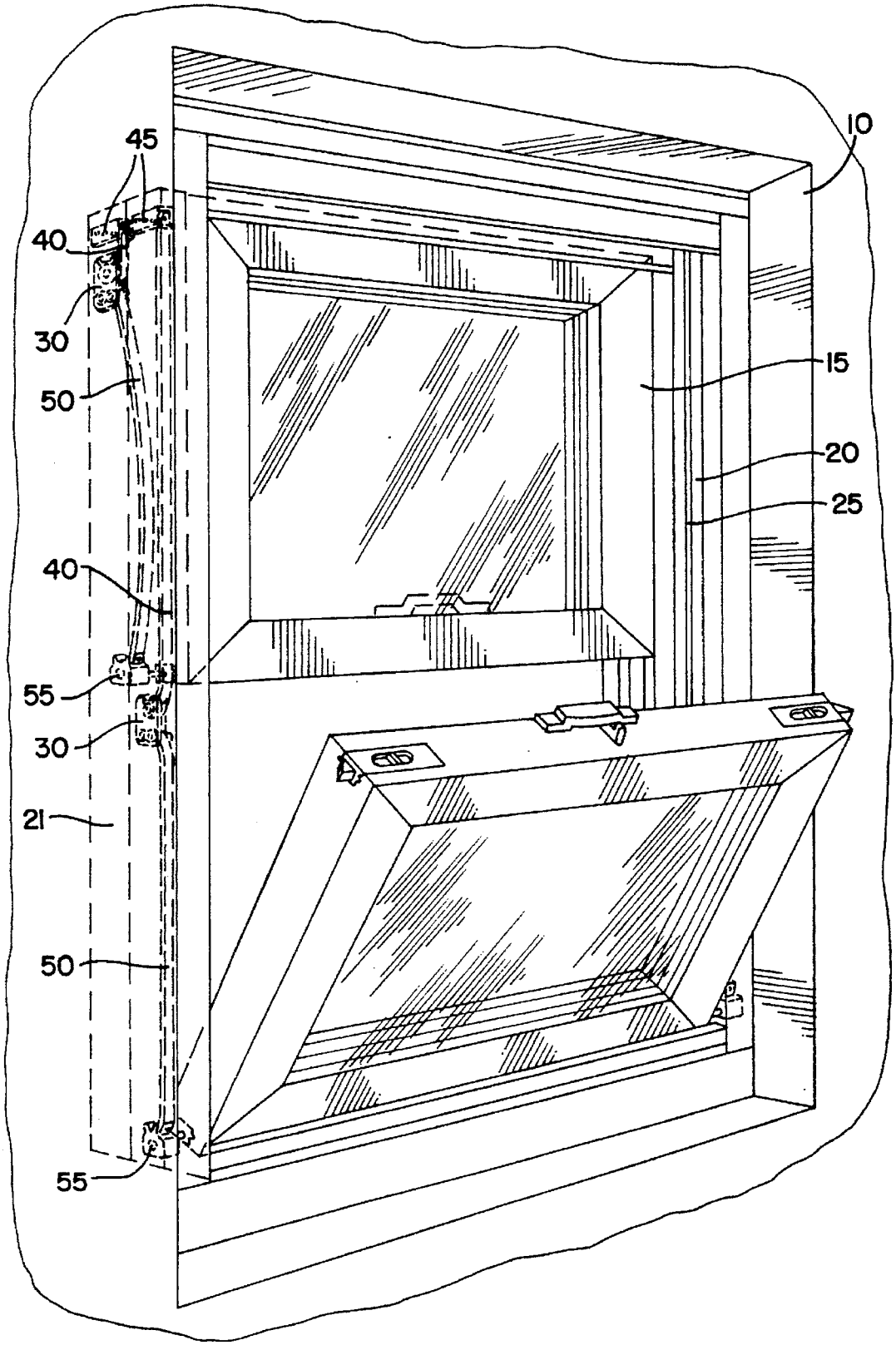
FIG. 1 is a perspective view of a pivotable sash window assembly disposed within a master frame, and includes the counterbalance assembly of the present invention.

While this invention is susceptible to embodiments in many different forms, there is shown in the drawings and will herein be described, in detail, preferred embodiments of the invention with the understanding that the present disclosure is to be considered as an exemplification of the principle of the invention and is not intended to limit the broad aspects of the invention to the embodiments illustrated.

Referring to FIG. 1, a pivotable sash window 15 is disposed within a master frame 10. The master frame 10 is comprised of a pair of opposed vertical guide rails 20 which are adapted to slidably guide the sash window 15 within the master frame 10. Each guide rail 20 is comprised of dual elongated channels 21 wherein both channels 21 have an elongated slot opening 25 on the inside of the guide rail 20.

Figure 2:
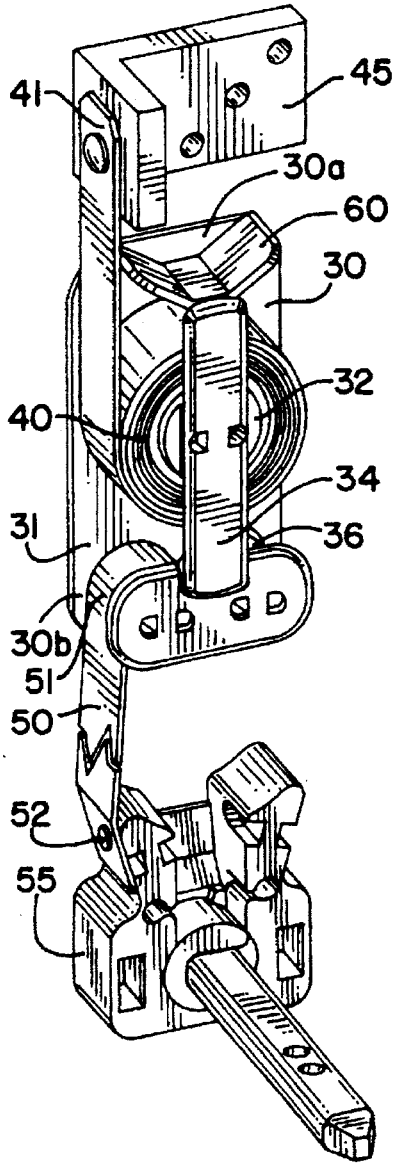
FIG. 2 is a perspective view of the counter-balance assembly of FIG. 1.
Figure 3:
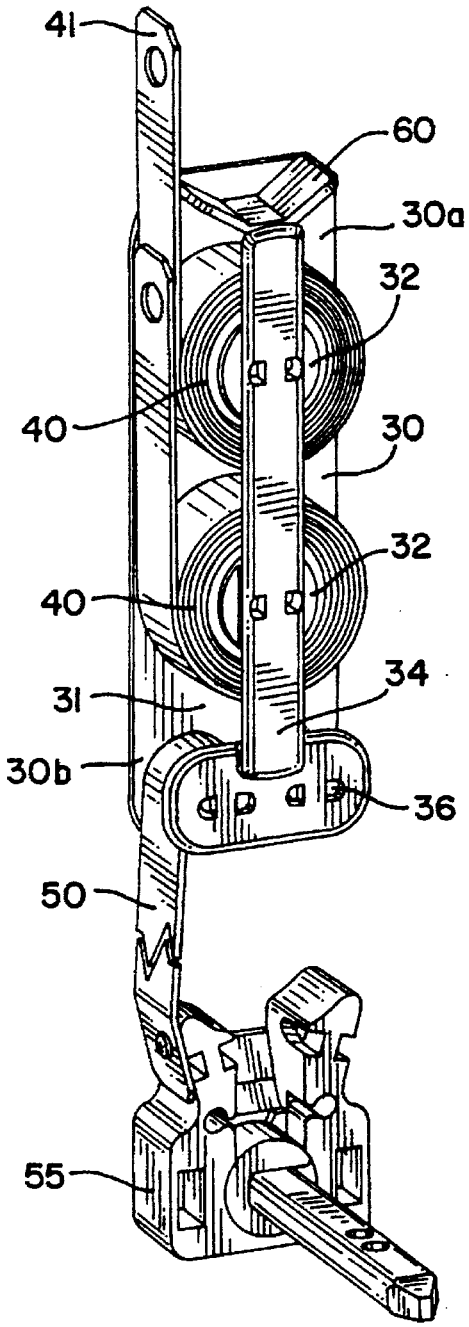
FIG. 3 is a perspective view of a counter-balance assembly in an alternate configuration.

Referring to FIGS. 1–3, a slidable counter-balance assembly 30 is adapted to fit within each guide rail channel 21. The counter-balance assembly 30 has a backplate 31 with an upper and a lower portion 30*a*,30*b*. An egress drum 32 is mounted on the backplate 31 and a coiled leaf spring 40 is spirally wound around the egress drum 32. Alternatively, the spring 40 could be mounted to a boss (not shown) extending outwardly from the backplate 31. Use of the drum 32, however, reduces noise. The spring 40 has an upper end 41 which is secured to a bracket 45. The bracket 45 is mounted at the top of the guide rail channel 21 as by screws. Alternatively, the upper end 41 of the spring 40 could be directly mounted at the top of the guide rail channel 21 as by screws.

A spring cover 34 is mounted in a position to retain the coiled spring 40 upon the drum 32. In the preferred configuration, the spring cover 34 is adapted to fit within the slot opening 25 of the guide rail channel 20. This arrangement allows a wider spring, as the width of the spring 40 is determined by the width of the channel 20 and the thickness of the backplate 31. The spring cover 34 may be a separate piece or may be a part of the backplate 31.

An optional debris catcher 60 is mounted on the upper portion of the backplate 31 in a position to prevent debris from interfering with the spring 40 operation.

A pair of bosses 36 may be mounted upon the lower portion of the backplate 31. Each boss 36 is adapted to receive a strap 50. The strap 50 is made of a flexible material such as metal, and has an upper end 51 and lower end 52. The upper end 51 of the strap 50 is attached to one of the bosses 36 and the lower end 52 of the strap is attached to a pivot brake assembly 55 which is mounted on a sash window 15. The particular boss utilized depends upon which side of the window the assembly is to be mounted.

The spring 40 counterbalances the weight of the sash window 15 in any position within the master frame 10 by exerting an upward force on the sash window 15. By adapting the spring cover 34 to fit within the channel slot opening 25, a wider spring 40 can be used within the channel 21. This configuration would allow for a stronger spring 40, having a longer effective length of travel, to be used in the assembly 30.

When the sash window 15 is positioned at the bottom of the master frame 10, the strap 50 pulls the counterbalance assembly 30 downwardly in the channel 21, thus uncoiling the spring 40. When the sash window 15 is moved to the top of the master frame 10, the strap 50 moves upwardly in the channel 21 allowing the counterbalance assembly 30 to slide upward. As the counterbalance assembly 30 slides upwardly, the spring 40 winds around the egress drum 32.

The spring 40 winds around the egress drum 32 until the counterbalance assembly 30 reaches the bracket 45 disposed at the top of the guide rail channel 21. The spring 40 cannot move beyond this position and this represents the normal full up position of the sash window 15. However, the sash window 15 can be displaced further upward by exerting an upward force on the sash window 15, thus causing the metal strap 50 to flex. This permits the sash to open further.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In combination with a sash window disposed within a master frame, wherein said master frame is comprised of a pair of opposed vertical guide rails, said guide rails adapted to slidably guide a pair of sash windows within said master frame, wherein each guide rail is comprised of dual elongated channels, each channel having a top and a bottom portion and an elongated slot opening on the inside of the guide rail which extends the length of the channel, the improvement comprising;

a slidable spring assembly adapted to fit within said guide rail channel and having a backplate with an upper and a lower portion, supporting means mounted on said backplate, a coiled leaf spring spirally wound around said supporting means and having an upper end, said upper end secured to the top portion of said guide rail channel, means for retaining said spring upon said supporting means, a strap having an upper and lower end, said upper strap end attached to a boss rigidly mounted on said backplate and said lower strap end attached to a pivot brake assembly mounted on a sash window.

2. The slidable spring assembly of claim 1 wherein said upper strap end is attached to a lower portion of said backplate.

3. The slidable spring assembly of claim 1 wherein said strap is a flexible metal strip.

4. The slidable spring assembly of claim 1 wherein a spring cover is adapted to fit within said elongated slot opening.

5. The slidable spring assembly of claim 1 wherein said support means includes an egress drum.

6. The slidable spring assembly of claim 1 including a bracket for securing said upper end of said spring to the top portion of said guide rail channel.

7. The slidable spring assembly of claim 5 including a second egress drum mounted upon the backplate and having a second coiled leaf spring spirally wound around said second egress drum and having an upper end, said upper end secured to the upper end of said guide rail channel.

8. The slidable spring assembly of claim 1 including a pair of said bosses mounted on the lower portion of said backplate to allow selective installation on either side of said master frame.

9. The slidable spring assembly of claim 1 including a debris catcher mounted on the upper portion of said backplate.

10. The slidable spring assembly of claim 1 wherein said retaining means comprises a spring cover.

11. In combination with a sash window disposed within a master frame, wherein said master frame is comprised of a pair of opposed vertical guide rails, said guide rails adapted to slidably guide a pair of sash windows within said master frame, wherein each guide rail is comprised of dual elongated channels, each channel having a top and bottom portion and an elongated slot opening on the inside of the guide rail which extends the length of the channel, the improvement comprising;

a slidable spring assembly adapted to fit within said guide rail channel and having a backplate with an upper and a lower portion, an egress drum mounted on said backplate, a coiled leaf spring spirally wound around said egress drum and having an upper end, said upper end secured to a bracket attached to the top portion of said guide rail channel, a spring cover mounted in a position to retain said spring upon said egress drum and adapted to fit within said elongated slot opening, a debris catcher mounted on the upper portion of said backplate, a pair of bosses mounted upon the lower portion of said backplate and adapted to receive a strap, wherein said strap is a flexible metal strip having an upper and lower end, said upper end attached to said boss and said lower end attached to a pivot brake assembly mounted on a sash window.

12. The slidable spring assembly of claim 11 wherein a second egress drum is mounted upon the backplate having a second coiled leaf spring spirally wound around said second egress drum and having an upper end, said upper end secured to a bracket attached to the upper end of said guide rail channel.

* * * * *